US008894173B2

(12) United States Patent
Terada

(10) Patent No.: US 8,894,173 B2
(45) Date of Patent: Nov. 25, 2014

(54) METHOD, INKJET PRINTER, AND SYSTEM FOR ACQUIRING DEVIATION VALUES OF INK LANDING POSITIONS

(71) Applicant: Kohei Terada, Kiyosu (JP)

(72) Inventor: Kohei Terada, Kiyosu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 13/845,817

(22) Filed: Mar. 18, 2013

(65) Prior Publication Data

US 2013/0278661 A1 Oct. 24, 2013

(30) Foreign Application Priority Data

Apr. 20, 2012 (JP) ..... 2012-097126

(51) Int. Cl.
*B41J 29/38* (2006.01)
*B41J 2/045* (2006.01)
*B41J 19/14* (2006.01)

(52) U.S. Cl.
CPC ..... *B41J 2/04501* (2013.01); *B41J 19/145* (2013.01)
USPC ..... 347/14

(58) Field of Classification Search
CPC ..... B41J 2/04501; B41J 2/04558; B41J 2/04573; B41J 29/38
USPC ..... 347/14, 19
See application file for complete search history.

(56) References Cited

U.S. PATENT DOCUMENTS

| | | | | |
|---|---|---|---|---|
| 6,092,939 | A | 7/2000 | Nishikori et al. | |
| 6,310,637 | B1 | 10/2001 | Shimada et al. | |
| 8,191,983 | B2 * | 6/2012 | Yoshida et al. | 347/14 |
| 2004/0126164 | A1 | 7/2004 | Ohyama | |
| 2006/0284953 | A1 * | 12/2006 | Hatasa et al. | 347/105 |
| 2008/0150978 | A1 | 6/2008 | Sato et al. | |
| 2008/0231649 | A1 * | 9/2008 | Kawabata et al. | 347/14 |
| 2009/0262157 | A1 | 10/2009 | Sato et al. | |
| 2010/0156977 | A1 * | 6/2010 | Kanematsu et al. | 347/14 |
| 2012/0086747 | A1 | 4/2012 | Terada | |

FOREIGN PATENT DOCUMENTS

| | | | |
|---|---|---|---|
| JP | 2003-54078 | A | 2/2003 |
| JP | 2004-17586 | A | 1/2004 |
| JP | 2004-106978 | A | 4/2004 |
| JP | 3554184 | B2 | 5/2004 |
| JP | 2006-167995 | A | 6/2006 |
| JP | 2006-192814 | A | 7/2006 |

(Continued)

*Primary Examiner* — Alessandro Amari
*Assistant Examiner* — Michael Konczal
(74) *Attorney, Agent, or Firm* — Scully, Scott, Murphy & Presser, PC

(57) ABSTRACT

A method including acquiring a first deviation value of ink landing positions in each position in a first range from a first pattern printed over the first range of a recording sheet in a scanning direction at a first moving velocity of an inkjet head, acquiring variation information representing a variation in the scanning direction of the first deviation value, acquiring from the variation information a first representative value representing the first deviation value in the first range, acquiring a second deviation value from a second pattern printed over a second range included in the first range at a second moving velocity of the inkjet head, acquiring a second representative value representing a deviation value in the first range at the second moving velocity, based on the second deviation value and a difference between the first representative value and the first deviation value in the second range.

10 Claims, 12 Drawing Sheets

(56) References Cited

FOREIGN PATENT DOCUMENTS

| | | | |
|---|---|---|---|
| JP | 2007-25492 | A | 2/2007 |
| JP | 2008-155423 | A | 7/2008 |
| JP | 2008-155424 | | 7/2008 |
| JP | 2009-23121 | A | 2/2009 |
| JP | 2009-143152 | A | 7/2009 |
| JP | 2009-202430 | A | 9/2009 |
| JP | 2012-76429 | A | 4/2012 |
| JP | 2012-96378 | A | 5/2012 |

* cited by examiner

METHOD, INKJET PRINTER, AND SYSTEM FOR ACQUIRING DEVIATION VALUES OF INK LANDING POSITIONS

CROSS-REFERENCE TO RELATED APPLICATION

This application claims priority under 35 U.S.C. §119 from Japanese Patent Application No. 2012-097126 filed on Apr. 20, 2012. The entire subject matter of the application is incorporated herein by reference.

BACKGROUND

1. Technical Field

The following description relates to one or more techniques for acquiring deviation values of ink landing positions in an inkjet printer.

2. Related Art

As an example of inkjet printers that perform printing by discharging ink droplets from nozzles onto a recording medium, an inkjet printer has been known that is configured to perform printing by discharging ink droplets onto a recording sheet (a recording medium) from a recording head (an inkjet head) mounted on a carriage reciprocating along a predetermined scanning direction. Further, the known inkjet printer is configured to cause feed rollers and corrugated holding spur wheels to press the recording sheet against a surface of a platen that has thereon convex portions and concave portions alternately formed along the scanning direction, so as to deform and hold the recording sheet in a predetermined wave shape. The predetermined wave shape has mountain portions protruding toward an ink discharge surface of the recording head, and valley portions recessed in a direction opposite to the direction toward the ink discharge surface, the mountain portions and the valley portions alternately arranged along the scanning direction.

SUMMARY

In the known inkjet printer, a gap (distance) between the ink discharge surface of the recording head and the recording sheet varies depending on portions (positions) on the recording sheet held in the wave shape (hereinafter, which may be referred to as a "wave-shaped recording sheet"). Therefore, when the known inkjet printer performs printing by discharging ink droplets from the recording head onto the wave-shaped recording sheet with the same ink discharge timing as when performing printing on a recording sheet not held in such a wave shape, there might be caused a deviation (difference) in the scanning direction between a landing position of an ink droplet discharged when the inkjet head moves toward one side along the scanning direction and a landing position of an ink droplet discharged when the inkjet head moves toward the other side along the scanning direction. In addition, the deviation value of ink landing positions differs from one portion (position) to another on the recording sheet.

In order to land ink droplets in appropriate positions on the wave-shaped recording sheet, for instance, it may be considered as one of possible solutions to adjust ink discharge timings (moments) to discharge the ink droplets from the inkjet head in response to the gap between the ink discharge surface and each portion (of the mountain portions and the valley portions) on the recording sheet. Further, in order to adjust the ink discharge timing, it is required to acquire a deviation value of ink landing positions on each portion of the wave-shaped recording sheet.

Further, for instance, the known inkjet printer may be configured to move the inkjet head at a plurality of moving velocities that differ depending on printing modes. In the meantime, the deviation value of ink landing positions varies depending on the moving velocities of the inkjet head. Furthermore, even when the recording sheet is not deformed in the wave shape, there might be caused a deviation of ink landing positions in the scanning direction as described above and a variation of the deviation value of ink landing positions depending on the moving velocities of the inkjet head. In such a case, it is required to acquire deviation values of ink landing positions for each moving velocity of the inkjet head.

Aspects of the present invention are advantageous to provide one or more improved techniques for acquiring, for each moving velocity of an inkjet head along a scanning direction, deviation values of ink landing positions in the scanning direction between when the inkjet head moves toward one side along the scanning direction and when the inkjet head moves toward the other side along the scanning direction.

According to aspects of the present invention, a method is provided for acquiring a deviation value between an ink landing position of an ink droplet discharged from an inkjet head of an inkjet printer moving toward a first side along a scanning direction and an ink landing position of an ink droplet discharged from the inkjet head moving toward a second side opposite to the first side along the scanning direction, for each of different moving velocities of the inkjet head, the inkjet printer configured to perform printing on a recording sheet by discharging ink droplets from nozzles formed in an ink discharge surface of the inkjet head while reciprocating the inkjet head relative to the recording sheet along the scanning direction parallel to the ink discharge surface, the method including a first pattern printing step of printing a first pattern over a first range of the recording sheet in the scanning direction, by discharging ink droplets from the nozzles while reciprocating the inkjet head at a first moving velocity along the scanning direction, the first pattern being a pattern for acquiring a first deviation value that is the deviation value of the ink landing positions in the first range when the inkjet head moves at the first moving velocity, a second pattern printing step of printing a second pattern over a second range of the recording sheet in the scanning direction, the second range being included in and shorter than the first range in the scanning direction, by discharging ink droplets from the nozzles while reciprocating the inkjet head at a second moving velocity different from the first velocity along the scanning direction, the second pattern being a pattern for acquiring a second deviation value that is the deviation value of the ink landing positions in the second range when the inkjet head moves at the second moving velocity, a first deviation acquiring step of acquiring, from the first pattern, the first deviation value in each of a plurality of positions in the first range, a variation acquiring step of acquiring variation information that represents a variation in the scanning direction of the first deviation value acquired in each of the plurality of positions in the first range, a first representative value acquiring step of acquiring, from the variation information, a first representative value that represents the first deviation value acquired in each of the plurality of positions in the first range, a second deviation acquiring step of acquiring the second deviation value from the second pattern, and a second representative value acquiring step of acquiring a second representative value that represents the deviation value of the ink landing positions in the first range when the inkjet head moves at the second moving velocity, based on the second deviation value and a difference between the first representative value and the first deviation value acquired in the second range included in the first range.

According to aspects of the present invention, further provided is an inkjet printer that includes an inkjet head configured to discharge ink droplets from nozzles formed in an ink discharge surface thereof, a head moving unit configured to reciprocate the inkjet head relative to a recording sheet along a scanning direction parallel to the ink discharge surface, and a control device configured to control the inkjet head and the head moving unit to print a pattern for acquiring a deviation value between an ink landing position of an ink droplet discharged when the inkjet head moves toward a first side along a scanning direction and an ink landing position of an ink droplet discharged when the inkjet head toward a second side opposite to the first side along the scanning direction, for each of different moving velocities of the inkjet head, the control device further configured to control the inkjet head and the head moving unit to print a first pattern over a first range of the recording sheet in the scanning direction, by discharging ink droplets from the nozzles while reciprocating the inkjet head at a first moving velocity along the scanning direction, the first pattern being a pattern for acquiring a first deviation value that is the deviation value of the ink landing positions in the first range when the inkjet head moves at the first moving velocity, and print a second pattern in a second range of the recording sheet in the scanning direction, the second range being included in and shorter than the first range in the scanning direction, by discharging ink droplets from the nozzles while reciprocating the inkjet head at a second moving velocity different from the first velocity along the scanning direction, the second pattern being a pattern for acquiring a second deviation value that is the deviation value of the ink landing positions in the second range when the inkjet head moves at the second moving velocity.

According to aspects of the present invention, further provided is a deviation value acquiring system that includes an image scanner configured to read the first pattern and the second pattern printed by the aforementioned inkjet printer, a first deviation acquirer configured to acquire, from a result obtained by reading the first pattern using the image scanner, the first deviation value in each of a plurality of positions in the first range, a variation acquirer configured to acquire variation information that represents a variation in the scanning direction of the first deviation value acquired in each of the plurality of positions in the first range, a first representative value acquirer configured to acquire, from the variation information, a first representative value that represents the first deviation value acquired in each of the plurality of positions in the first range, a second deviation acquirer configure to acquire the second deviation value from a result obtained by reading the second pattern using the image scanner, and a second representative value acquirer configured to acquire a second representative value that represents the deviation value of the ink landing positions in the first range when the inkjet head moves at the second moving velocity, based on the second deviation value and a difference between the first representative value and the first deviation value acquired in the second range included in the first range.

BRIEF DESCRIPTION OF THE ACCOMPANYING DRAWINGS

Figure 1:
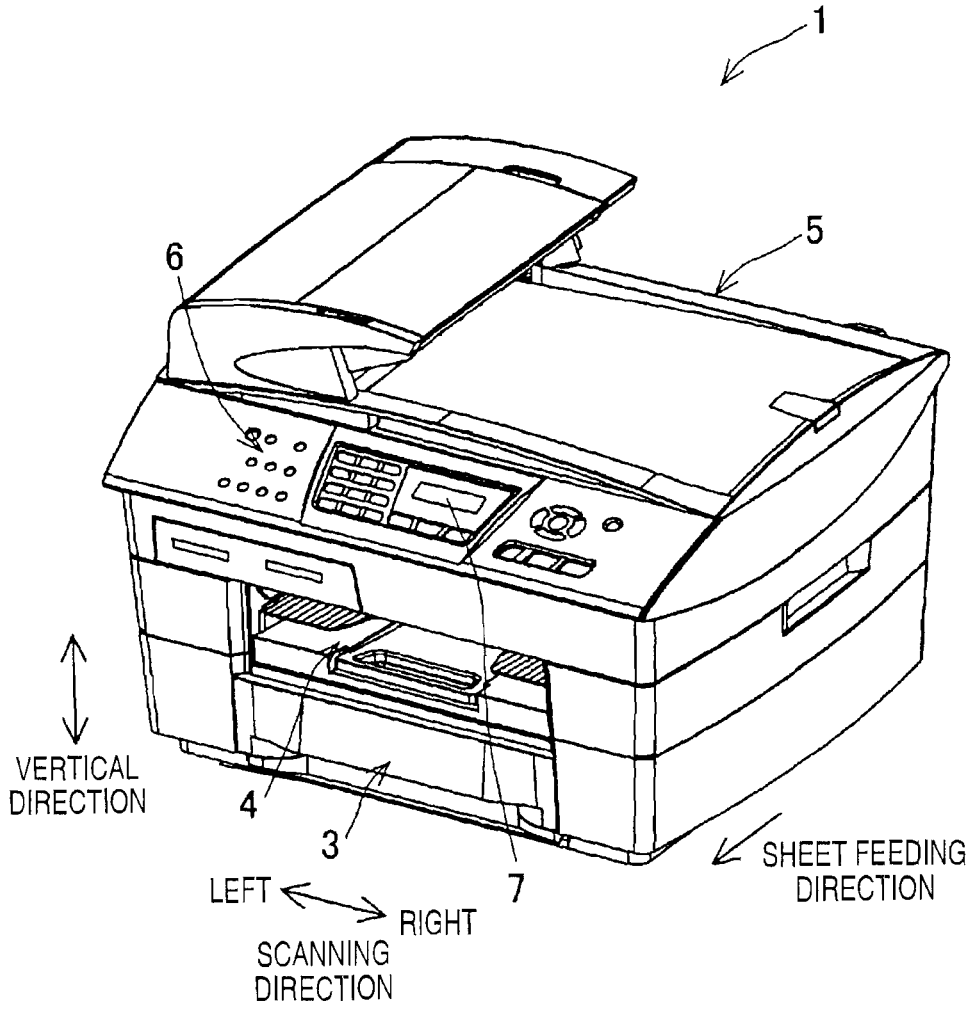
FIG. 1 is a perspective view schematically showing a configuration of an inkjet printer in an embodiment according to one or more aspects of the present invention.
Figure 2:
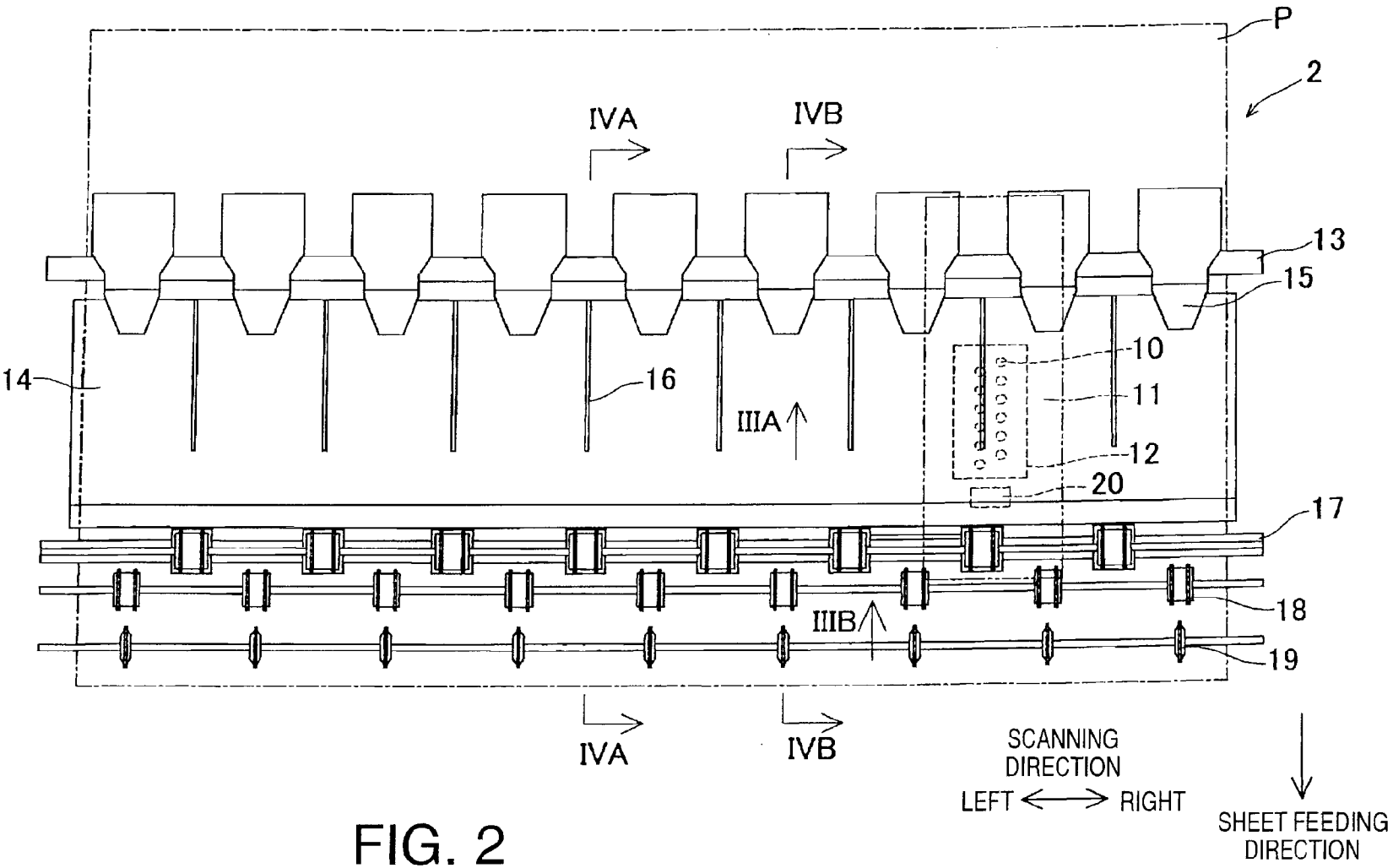
FIG. 2 is a top view of a printing unit of the inkjet printer in the embodiment according to one or more aspects of the present invention.
Figure 3A:
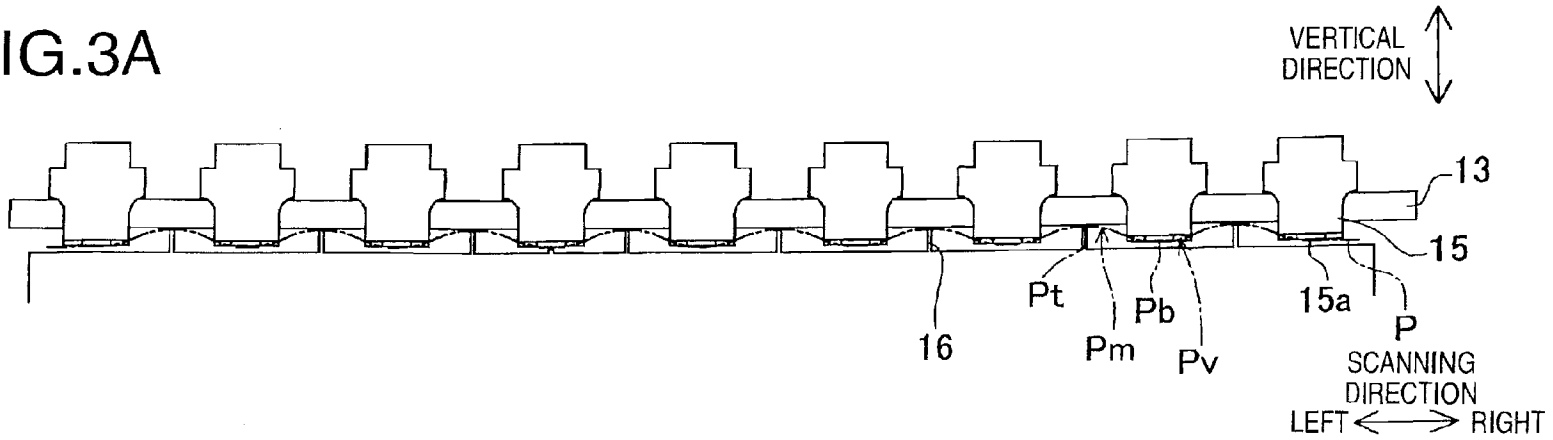

FIG. 3A schematically shows a part of the printing unit when viewed along an arrow IIIA shown in FIG. 2 in the embodiment according to one or more aspects of the present invention.

Figure 3B:
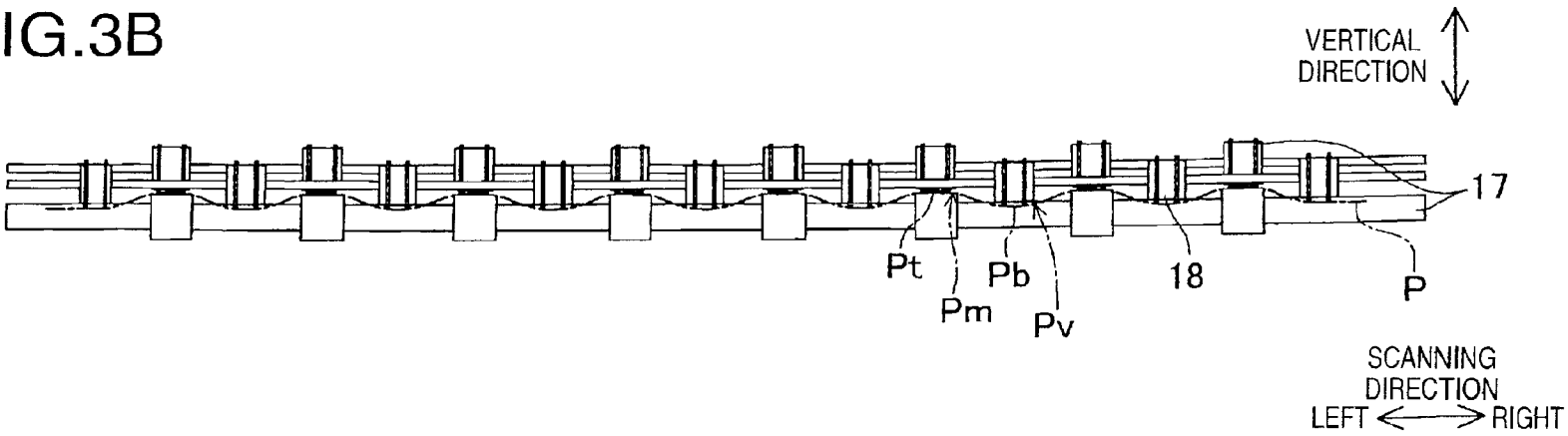

FIG. 3B schematically shows a part of the printing unit when viewed along an arrow IIIB shown in FIG. 2 in the embodiment according to one or more aspects of the present invention.

Figure 4A:
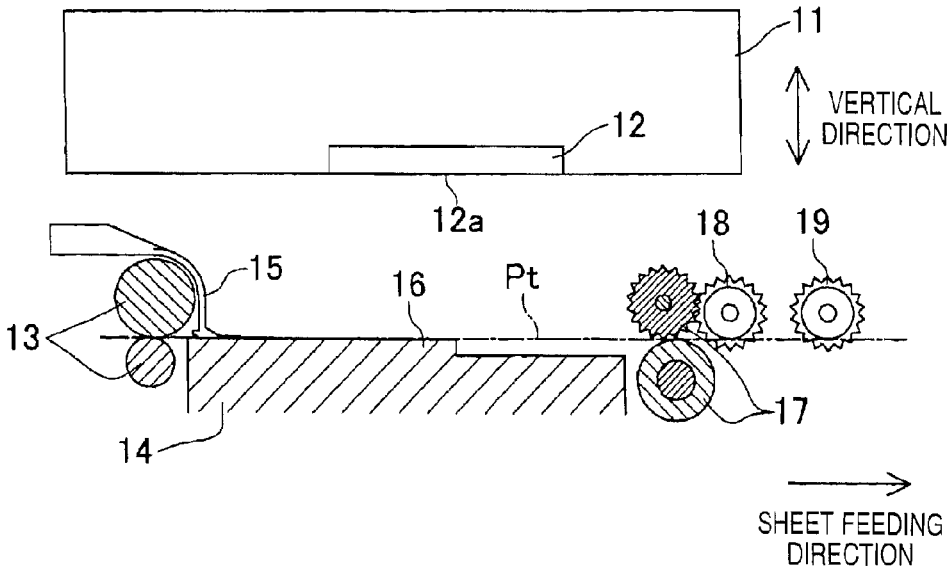

FIG. 4A is a cross-sectional view taken along a line IVA-IVA shown in FIG. 2 in the embodiment according to one or more aspects of the present invention.

Figure 4B:
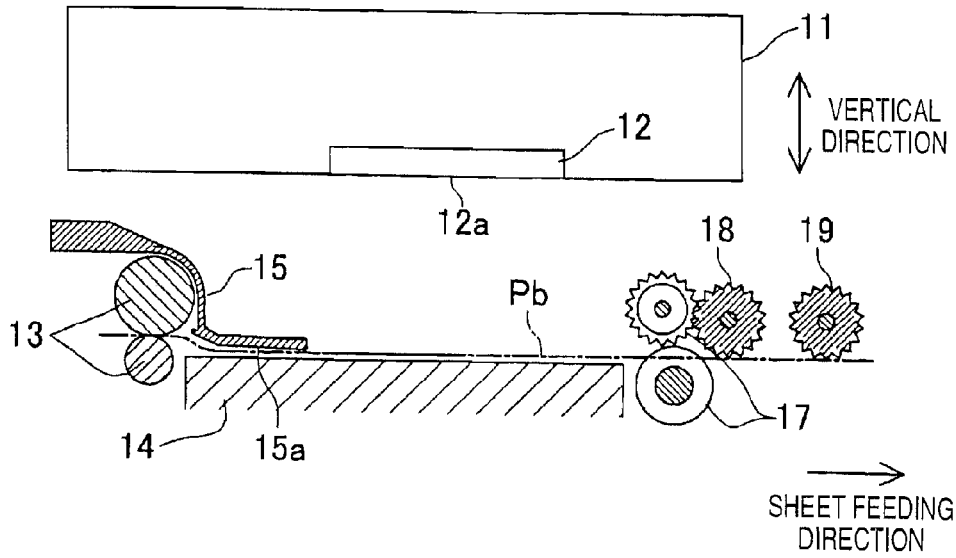

FIG. 4B is a cross-sectional view taken along a line IVB-IVB shown in FIG. 2 in the embodiment according to one or more aspects of the present invention.

Figure 5:
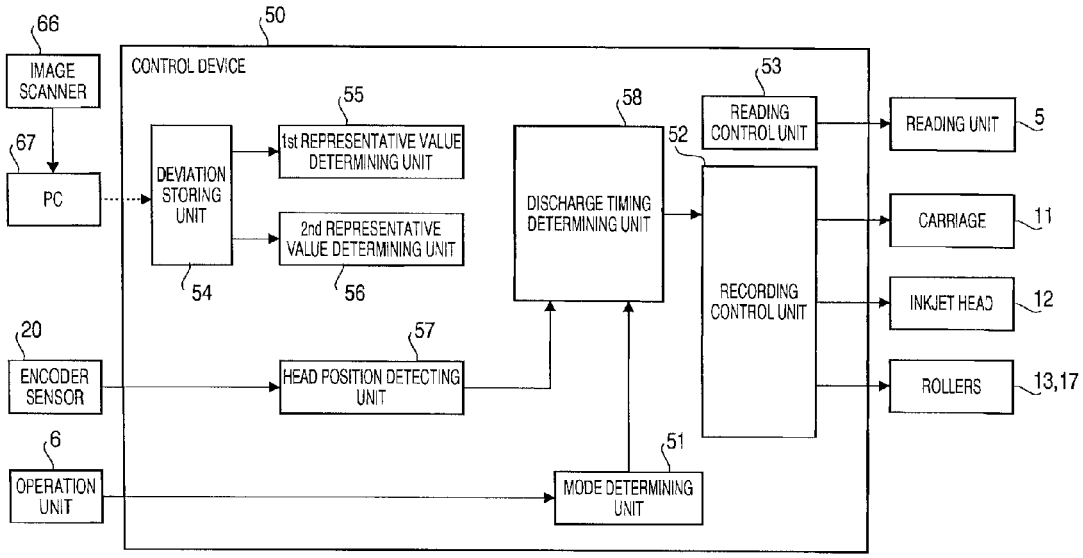

FIG. 5 is a functional block diagram of a control device of the inkjet printer in the embodiment according to one or more aspects of the present invention.

Figure 6:
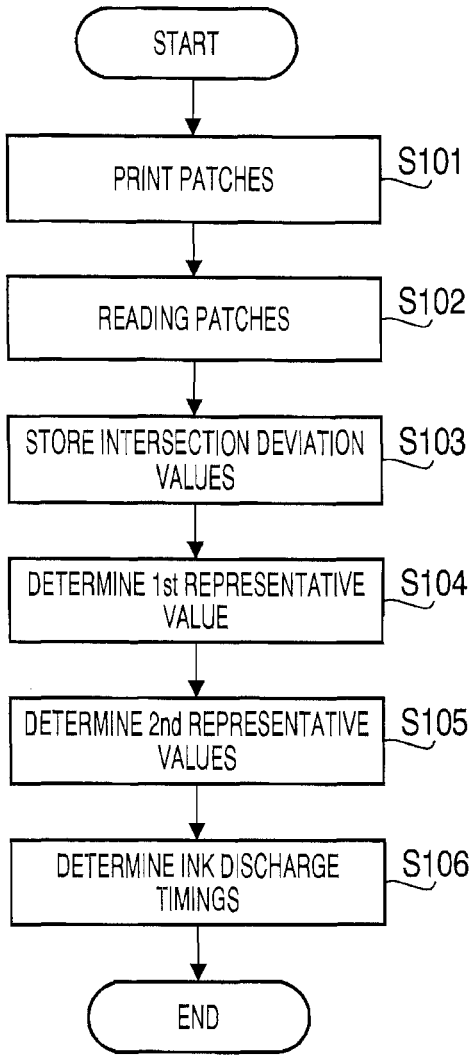

FIG. 6 is a flowchart showing a process to determine ink discharging timings (moments) to discharge ink droplets from nozzles in the inkjet printer, in the embodiment according to one or more aspects of the present invention.

Figure 7A:
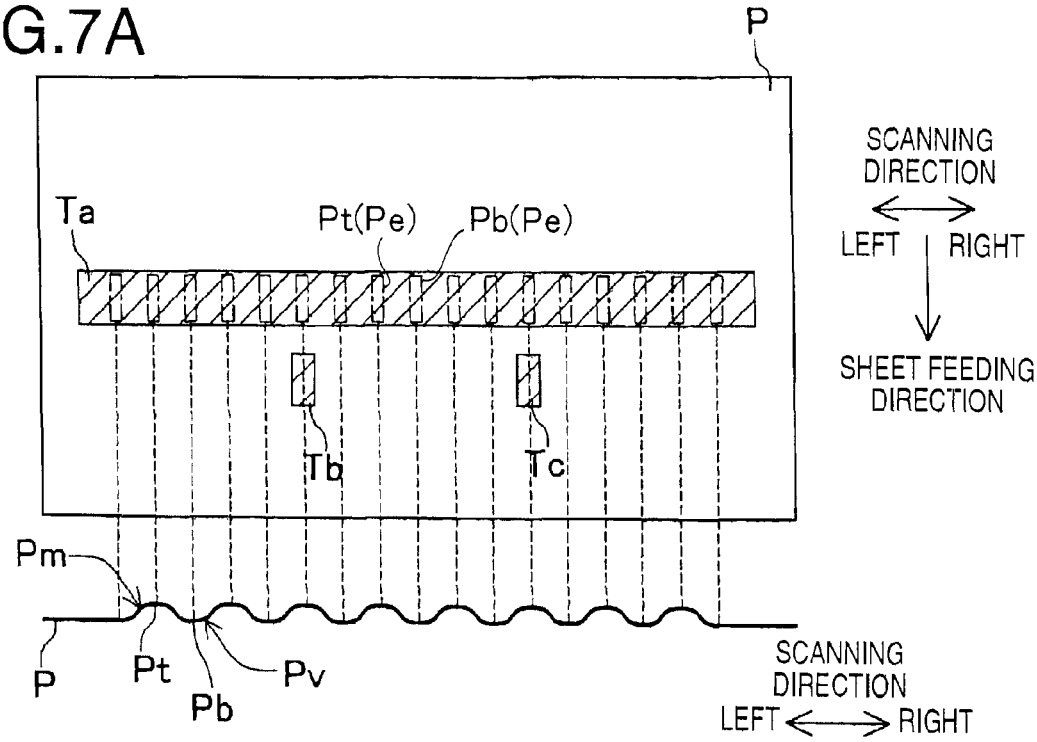

FIG. 7A shows sections to be read of three patches each including a plurality of deviation detecting patterns printed on a recording sheet in the embodiment according to one or more aspects of the present invention.

Figure 7B:
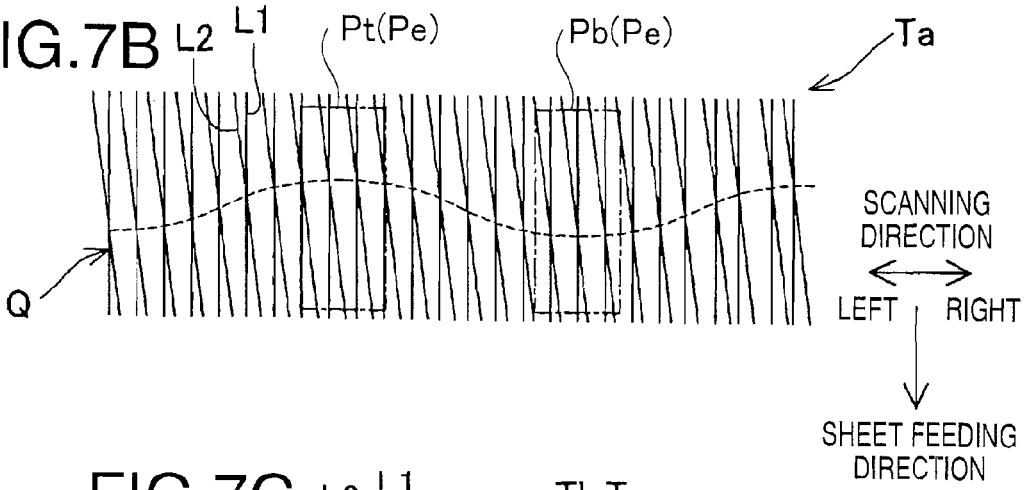

FIG. 7B is an enlarged view partially showing one of the three patches that extends over a whole range of the recording sheet in a scanning direction in the embodiment according to one or more aspects of the present invention.

Figure 7C:
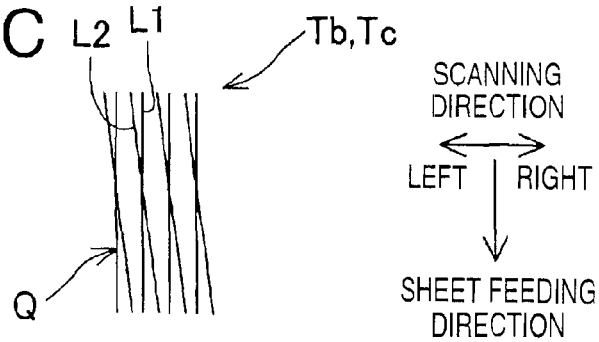

FIG. 7C is an enlarged view showing one of the three patches that is formed in a partial range of the recording sheet in the scanning direction in the embodiment according to one or more aspects of the present invention.

Figure 8A:
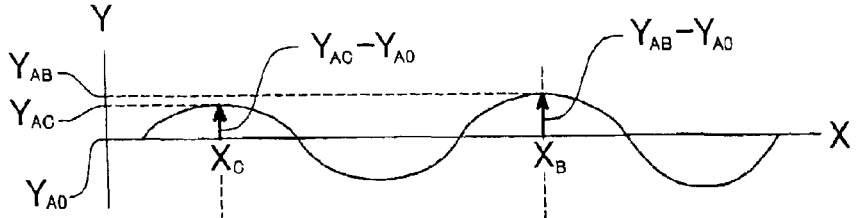
Figure 8B:
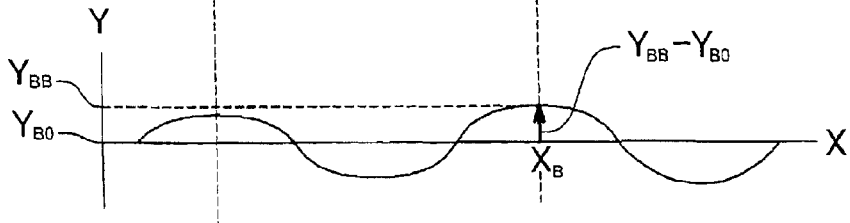
Figure 8C:
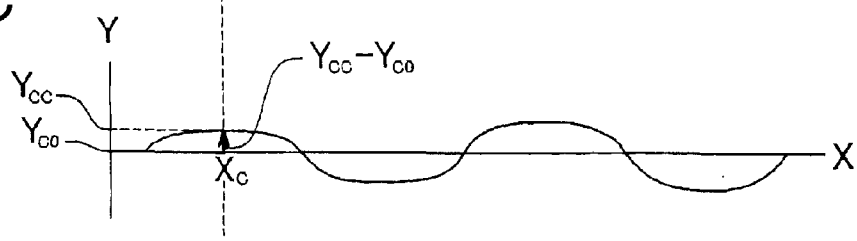

FIGS. 8A, 8B, and 8C each shows a variation in the scanning direction of a difference between an intersection deviation value and an average value of intersection deviation values, for a corresponding one of moving velocities of an inkjet head in the embodiment according to one or more aspects of the present invention.

Figure 9:
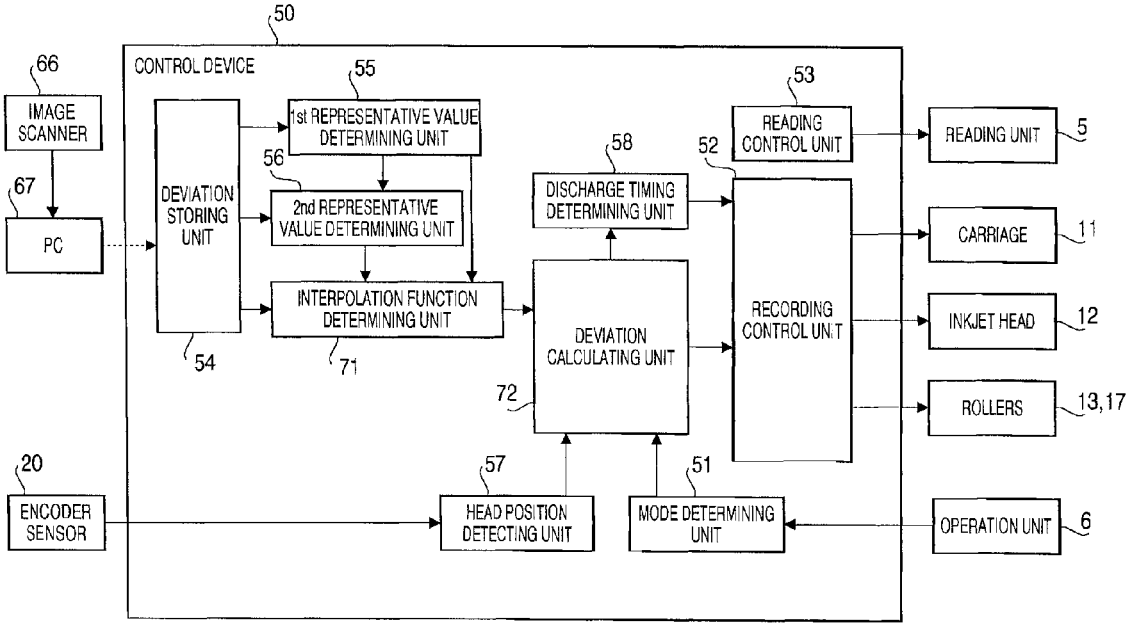

FIG. 9 is a functional block diagram of a control device of the inkjet printer in a first modification according to one or more aspects of the present invention.

Figure 10A:
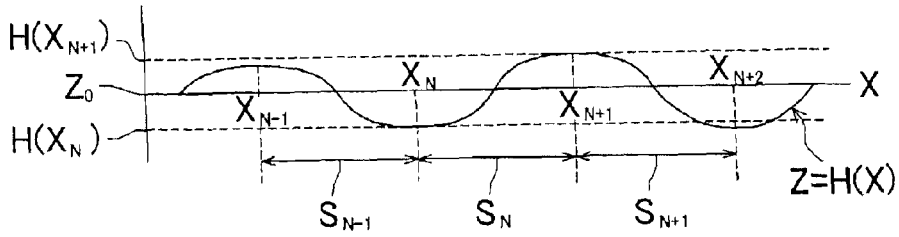

FIG. 10A shows a relationship between a position in the scanning direction of the recording sheet and a height of the recording sheet in the first modification according to one or more aspects of the present invention.

Figure 10B:
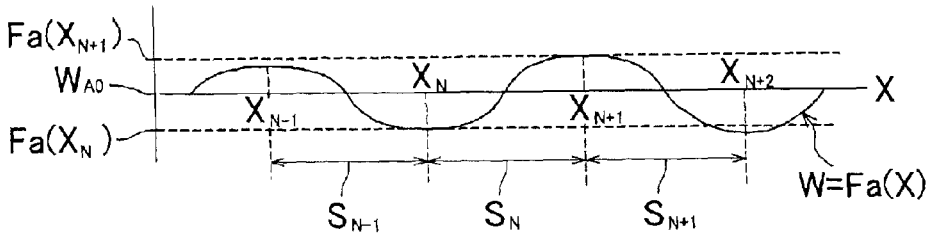

FIG. 10B shows a relationship between the position in the scanning direction of the recording sheet and a positional deviation value in the scanning direction of an ink droplet landing in the position on the recording sheet in the first modification according to one or more aspects of the present invention.

Figure 10C:
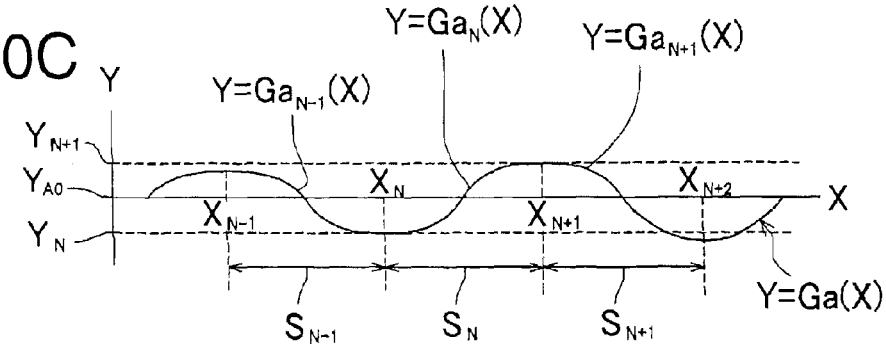

FIG. 10C shows a relationship between the position in the scanning direction of the recording sheet and an intersection deviation value in a sheet feeding direction of a pattern intersection formed in the position on the recording sheet in the first modification according to one or more aspects of the present invention.

Figure 10D:
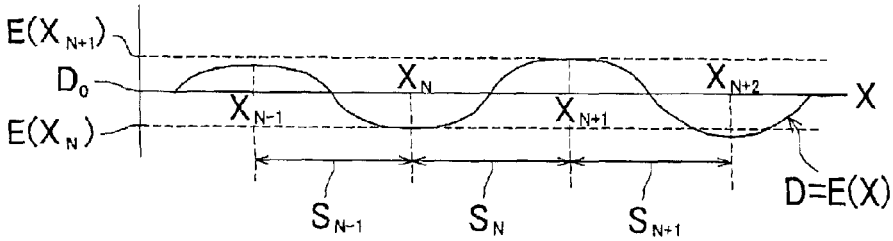

FIG. 10D shows a relationship between the position in the scanning direction of the recording sheet and a delay time for adjusting the ink discharging timing in the first modification according to one or more aspects of the present invention.

Figure 11:
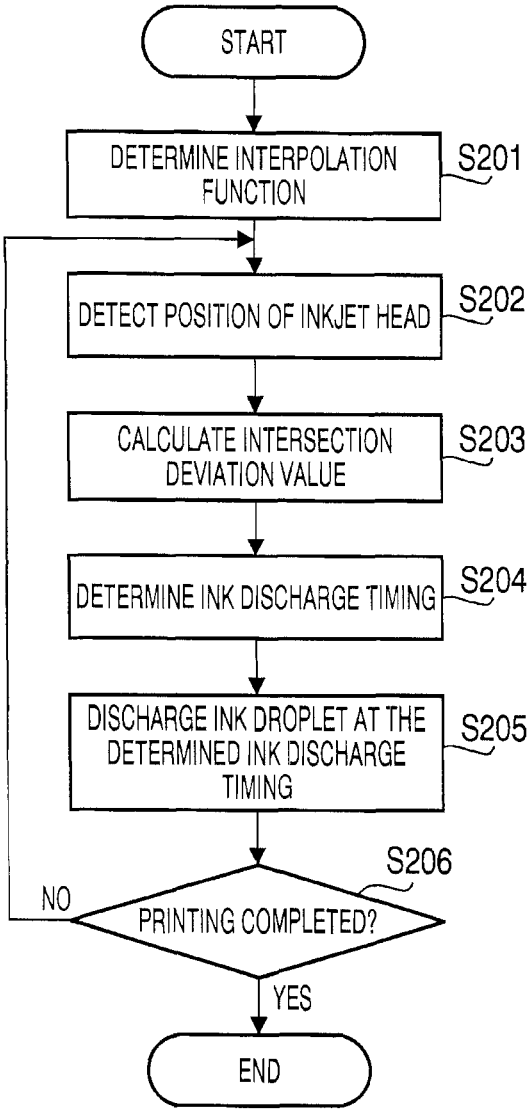

FIG. 11 is a flowchart showing a process to be executed in the printing operation, in a procedure to determine the ink discharge timing in the first modification according to one or more aspects of the present invention.

Figure 12:
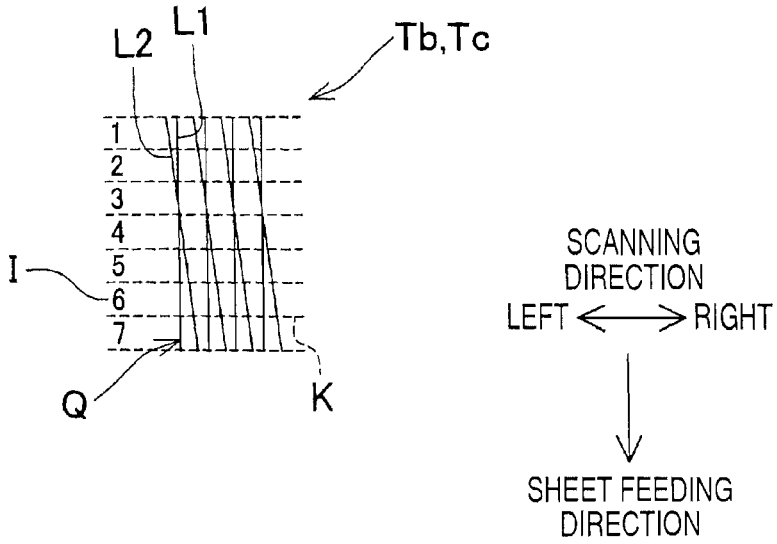

FIG. 12 is an enlarged view showing one of three patches that is formed in a partial range of the recording sheet in the scanning direction in a second modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) or in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described in detail with reference to the accompanying drawings.

An inkjet printer 1 of the embodiment is a multi-function peripheral having a plurality of functions such as a printing function to perform printing on a recording sheet P and an image reading function. The inkjet printer 1 includes a printing unit 2 (see FIG. 2), a sheet feeding unit 3, a sheet ejecting unit 4, a reading unit 5, an operation unit 6, and a display unit 7. Further, the inkjet printer 1 includes a control device 50 configured to control operations of the inkjet printer 1 (see FIG. 5).

The printing unit 2 is disposed inside the inkjet printer 1. The printing unit 2 is configured to perform printing on the recording sheet P. A detailed configuration of the printing unit 2 will be described later. The sheet feeding unit 3 is configured to feed the recording sheet P to be printed by the printing unit 2. The sheet ejecting unit 4 is configured to eject the recording sheet P printed by the printing unit 2. The reading unit 5 is configured, e.g., as an image scanner, to read images. The operation unit 6 is provided with buttons. A user is allowed to operate the inkjet printer 1 via the buttons of the operation unit 6. The display unit 7 is configured, e.g., as a liquid crystal display, to display information necessary in the use of the inkjet printer 1.

Subsequently, the printing unit 2 will be described. As shown in FIGS. 2 to 4, the printing unit 2 includes a carriage 11, an inkjet head 12, feed rollers 13, a platen 14, a plurality of corrugated plates 15, a plurality of ribs 16, ejection rollers 17, and a plurality of corrugated spur wheels 18 and 19. It is noted that, for the sake of easy visual understanding in FIG. 2, the carriage 11 is indicated by a long dashed double-short dashed line, and portions disposed below the carriage 11 are indicated by solid lines.

The carriage 11 is configured to reciprocate along a scanning direction while guided by a guide rail (not shown). The inkjet head 12 is mounted on the carriage 11. The inkjet head 12 is configured to discharge ink droplets from a plurality of nozzles 10 formed in an ink discharge surface 12*a* that is a lower surface of the inkjet head 12. The feed rollers 13 are two rollers configured to pinch therebetween the recording sheet P fed by the sheet feeding unit 3 and feed the recording sheet P in a sheet feeding direction perpendicular to the scanning direction. The platen 14 is disposed to face the ink discharge surface 12*a*. The recording sheet P is fed by the feed rollers 13, along an upper surface of the platen 14.

The plurality of corrugated plates 15 are disposed to face an upper surface of an upstream end of the platen 14 in the sheet feeding direction. The plurality of corrugated plates 15 are arranged at substantially regular intervals along the scanning direction. The recording sheet P, fed by the feed rollers 13, passes between the platen 14 and the corrugated plates 15. At this time, the recording sheet P is pressed from above by pressing surfaces 15*a* that are lower surfaces of the plurality of corrugated plates 15. Each individual rib 16 is disposed between corresponding two mutually-adjacent corrugated plates 15 in the scanning direction, on the upper surface of the platen 14. The plurality of ribs 16 are arranged at substantially regular intervals along the scanning direction. Each rib 16 protrudes from the upper surface of the platen 14 up to a level higher than the pressing surfaces 15*a* of the corrugated plates 15. Each rib 16 extends from an upstream end of the platen 14 toward a downstream side in the sheet feeding direction. Thereby, the recording sheet P on the platen 14 is supported from underneath by the plurality of ribs 16.

The ejection rollers 17 are two rollers configured to pinch therebetween portions of the recording sheet P that are located in the same positions as the plurality of ribs 16 in the scanning direction and feed the recording sheet P toward the sheet ejecting unit 4. An upper one of the ejection rollers 17 is provided with spur wheels so as to prevent the ink attached onto the recording sheet P from transferring to the upper ejection roller 17. The plurality of corrugated spur wheels 18 are disposed substantially in the same positions as the corrugated plates 15 in the scanning direction, at a downstream side relative to the ejection rollers 17 in the sheet feeding direction. The plurality of corrugated spur wheels 19 are disposed substantially in the same positions as the corrugated plates 15 in the scanning direction, at a downstream side relative to the corrugated spur wheels 18 in the sheet feeding direction. In addition, the plurality of corrugated spur wheels 18 and 19 are placed at a level lower than a position where the ejection rollers 17 pinch the recording sheet P therebetween, in the vertical direction. The plurality of corrugated spur wheels 18 and 19 are configured to press the recording sheet P from above at the level. Further, each of the plurality of corrugated spur wheels 18 and 19 is not a roller having a flat outer circumferential surface but a spur wheel. Therefore, it is possible to prevent the ink attached onto the recording sheet P from transferring to the plurality of corrugated spur wheels 18 and 19.

Thus, the recording sheet P on the platen 14 is pressed from above by the plurality of corrugated plates 15 and the plurality of corrugated spur wheels 18 and 19, and is supported from underneath by the plurality of ribs 16. Thereby, as shown in FIGS. 3A and 3B, the recording sheet P on the platen 14 is deformed and held in such a wave shape that mountain portions Pm protruding upward (i.e., toward the ink discharge surface 12*a*) and valley portions Pv recessed downward (i.e., in a direction opposite to the direction toward the ink discharge surface 12*a*) are alternately arranged. Further, each mountain portion Pm has a top portion (peak portion) Pt, protruding up to the highest level of the mountain portion Pm, which is located substantially in the same position as center of the corresponding rib 16 in the scanning direction. Each valley portion Pv has a bottom portion Pb, recessed down to the lowest level of the valley portion Pv, which is located substantially in the same position as the corresponding corrugated plate 15 and the corresponding corrugated spur wheels 18 and 19.

An encoder sensor 20 is mounted on the carriage 11. The encoder sensor 20, together with an encoder belt (not shown) extending along the scanning direction, forms a linear encoder. The encoder sensor 20 is configured to detect slits formed in the encoder belt and thereby detect a position of the inkjet head 12 moving together with the carriage 11 along the scanning direction.

The printing unit 2 configured as above performs printing on the recording sheet P, by discharging ink droplets from the inkjet head 12 reciprocating together with the carriage 11 along the scanning direction while feeding the recording sheet P in the sheet feeding direction by the feed rollers 13 and the ejection rollers 17.

Next, an explanation will be provided about the control device 50 for controlling the operations of the inkjet printer 1. The control device 50 includes a central processing unit (CPU), a read only memory (ROM), a random access memory (RAM), and control circuits. Thereby, as shown in FIG. 5, the control device 50 is configured to serve as a plurality of units such as a mode determining unit 51, a recording control unit 52, a reading control unit 53, a deviation storing unit 54, a first representative value determining unit 55, a second representative value determining unit 56, a head position detecting unit 57, and a discharge timing determining unit 58.

The mode determining unit 51 is configured to determine a printing mode for a printing operation to be performed by the printing unit 2, e.g., in response to a user operation via the operation unit 6. The printing unit 2 is configured to perform the printing operation in one of a first printing mode, a second printing mode, and a third printing mode. In the first printing mode, the second printing mode, and the third printing mode, the inkjet head 12 (the carriage 11) is moved at a moving velocity $V_A$, a moving velocity $V_B$, and a moving velocity $V_C$, respectively. For example, a combination of the first printing mode, the second printing mode, and the third printing mode may correspond to a combination of monochrome printing, a low-resolution color printing, and a high-resolution color printing.

The recording control unit 52 is configured to control operations of the carriage 11, the inkjet head 12, the feed rollers 13, and the ejection rollers 17 when the inkjet printer 1 performs the printing operation. The reading control unit 53 is configured to control operations of the reading unit 5 in an image reading operation. As will be described later, the deviation storing unit 54 is configured to store a deviation value (hereinafter, which may be referred to as an intersection deviation value) in the sheet feeding direction of an intersection between two lines of a deviation detecting pattern formed on each individual portion of the plurality of top portions Pt and the plurality of bottom portions Pb of the recording sheet P.

The first representative value determining unit 55 is configured to determine an average value (a first representative value) of the intersection deviation values over a whole range of the recording sheet P in the scanning direction in the case of the moving velocity $V_A$ of the inkjet head 12. The second representative value determining unit 56 is configured to determine an average value (a second representative value) of the intersection deviation values over the whole range of the recording sheet P in the scanning direction when the moving velocity of the inkjet head 12 is the moving velocity $V_B$ or the moving velocity $V_C$.

The head position detecting unit 57 is configured to detect a position of the inkjet head 12 reciprocating together with the carriage 11 along the scanning direction in the printing operation, from a result of detection by the encoder sensor 20. The discharge timing determining unit 58 is configured to determine ink discharge timings (moments) to discharge ink droplets from the nozzles 10, based on the printing mode determined by the mode determining unit 51, one of the first representative value and the second representative value, and a reference discharge timing (moment) determined based on the position of the inkjet head 12 detected by the head position detecting unit 57. It is noted that the term "timing," which will frequently be referred to in the following description, may have the same meaning as "a moment" or "a time."

Subsequently, an explanation will be provided about a procedure, in the inkjet printer 1, for determining the ink discharge timings (moments) to discharge ink droplets from the nozzles 10. In order to determine the ink discharge timings (moments) to discharge ink droplets from the nozzles 10, as will be described below, steps S101 to S106 as shown in FIG. 6 are previously performed in advance of execution of the printing operation using the inkjet printer 1 (e.g., at a stage of manufacturing the inkjet printer 1).

In S101, the control device 50 (the recording control unit 52) controls the printing unit 2 (the inkjet head 12) to print on the recording sheet P three patches Ta, Tb, and Tc as shown in FIGS. 7A, 7B, and 7C. More specifically, for instance, the control device 50 controls the printing unit 2 to print a plurality of straight lines L1, which extend in parallel with the sheet feeding direction and are arranged along the scanning direction, by discharging ink droplets from the nozzles 10 while moving the carriage 11 toward one side along the scanning direction. After that, the control device 50 controls the printing unit 2 to print a plurality of straight lines L2, which are tilted with respect to the sheet feeding direction and intersect the plurality of straight lines L1, respectively, by discharging ink droplets from the nozzles 10 while moving the carriage 11 toward the other side along the scanning direction. Thereby, as shown in FIGS. 7A, 7B, and 7C, the patches Ta, Tb, and Tc are printed, each patch including a plurality of deviation detecting patterns Q arranged along the scanning direction, each deviation detecting pattern Q including a combination of the mutually intersecting straight lines L1 and L2. It is noted that, at this time, the ink droplets are discharged from the nozzles 10 in accordance with design-based ink discharging timings (moments) determined, for example, based on an assumption that the recording sheet P is not in the wave shape but flat.

It is noted that, when printing the straight lines L1 and L2 of the patch Ta, the inkjet head 12 is controlled to move at the moving velocity $V_A$ and print the deviation detecting patterns Q substantially over the whole range (a first range) of the recording sheet P in the scanning direction. Additionally, the inkjet head 12 is controlled to print the patch Ta substantially in a central portion of the recording sheet P in the sheet feeding direction. Meanwhile, when printing the straight lines L1 and L2 of the patch Tb, the inkjet head 12 is controlled to move at the moving velocity $V_B$ and print the deviation detecting patterns Q on a single mountain portion Pm (a second range that is included in the first range and narrower than the first range) in the scanning direction. Further, when printing the straight lines L1 and L2 of the patch Tc, the inkjet head 12 is controlled to move at the moving velocity $V_C$ and print the deviation detecting patterns Q on another single mountain portion Pm (a second range that is included in the first range and narrower than the first range) in the scanning direction. The patches Tb and Tc are printed to be arranged along the scanning direction, on respective different mountain portions Pm in a different position in the sheet feeding direction from the patch Ta.

In S102, an image scanner 66, which is provided separately from the inkjet printer 1, is caused to read the plurality of deviation detecting patterns Q of the patches Ta, Tb, and Tc printed in S101. Further, in S102, a PC 67, which is connected with the image scanner 66, is caused to acquire the intersection deviation values from the read deviation detecting patterns Q. It is noted that, instead of the image scanner 66, the reading unit 5 may read the plurality of deviation detecting patterns Q. Further, instead of the PC 67, the control device 50 may acquire the intersection deviation values from the read deviation detecting patterns Q.

More specifically, for example, when the deviation detecting patterns Q as shown in FIGS. 7A, 7B, and 7C are printed in a situation where there is a deviation (difference) in the scanning direction between a landing position of an ink droplet discharged when the carriage 11 is moved rightward along the scanning direction and a landing position of an ink droplet discharged when the carriage 11 is moved leftward along the scanning direction, the straight line L1 and the straight line L2 of a deviation detecting pattern Q are printed to be deviated from each other in the scanning direction. Therefore, the straight line L1 and the straight line L2 form an intersection thereof (hereinafter referred to as a pattern intersection) in a position deviated in the sheet feeding direction depending on a deviation value in the scanning direction between the ink landing positions. Further, when the reading unit 5 reads each deviation detecting pattern Q, the reading unit 5 detects a higher brightness at the pattern intersection than the brightness at any other portion of the read deviation detecting pattern Q. This is because a ratio of areas (black) of the straight lines L1 and L2 relative to background areas (white) of the recording sheet P is smaller at the pattern intersection than at any other portion. Accordingly, by reading each deviation detecting pattern Q and acquiring a position where the highest brightness is detected within the read deviation detecting pattern Q, it is possible to detect the position of the intersection of the straight lines L1 and L2 in the sheet feeding direction.

A positional deviation in the sheet feeding direction of the intersection of the straight lines L1 and L2 is proportional to a positional deviation in the scanning direction of the intersection of the straight lines L1 and L2. Specifically, when an angle between the straight lines L1 and L2 is θ, the positional deviation in the sheet feeding direction of the intersection of the straight lines L1 and L2 is 1/tan θ times as large as the positional deviation in the scanning direction of the intersection of the straight lines L1 and L2. Thus, by detecting the intersection deviation value of a pattern intersection in the sheet feeding direction, it is possible to acquire information on a deviation value in the scanning direction between ink landing positions in bidirectional printing.

In the embodiment, an intersection deviation value (a first deviation value) on each individual portion of the top portions Pt and the bottom portions Pb in the case of the moving velocity $V_A$ of the inkjet head 12 is acquired by reading deviation detecting patterns Q printed on the corresponding portion of the top portions Pt and the bottom portions Pb of the recording sheet P (see sections surrounded by alternate long and short dash lines in FIG. 7A, which may hereinafter be referred to as examined sections Pe), among the plurality of deviation detecting patterns Q included in the patch Ta.

Further, by reading the deviation detecting patterns Q included in the patch Tb, intersection deviation values (second deviation values) in positions where the deviation detecting patterns Q of the patch Tb are printed at the moving velocity $V_B$ of the inkjet head 12 are acquired. Likewise, by reading the deviation detecting patterns Q included in the patch Tc, intersection deviation values (second deviation values) in positions where the deviation detecting patterns Q of the patch Tc are printed at the moving velocity $V_C$ of the inkjet head 12 are acquired.

In S102, as described above, regarding the patch Ta, only the deviation detecting patterns Q printed on the top portions Pt and the bottom portions Pb of the recording sheet P are read out. Therefore, in S101, with respect to the patch Ta, it is only necessary to print the deviation detecting patterns Q at least on the top portions Pt and the bottom portions Pb of the recording sheet P.

In S103, as indicated by a dashed line in FIG. 5, the deviation storing unit 54 is communicably connected with the PC 67, and is caused to store the intersection deviation values acquired in S102. It is noted that the connection between the deviation storing unit 54 and the PC 67 may be established at any time before S103.

In S104, the control device 50 (the first representative value determining unit 55) calculates an average value $Y_{A0}$ (a first representative value) of the intersection deviation values over the whole range of the recording sheet P in the scanning direction when the inkjet head 12 is moved at the moving velocity $V_A$. Specifically, the control device 50 determines, as the value $Y_{A0}$, an average value of the intersection deviation values, stored in the deviation storing unit 54 in S103, on the top portions Pt and the bottom portions Pb. It is noted that an anterior one of index letters added to "Y" represents the moving velocity of the inkjet head 12 in the printing operation. Additionally, a posterior one of them represents a position in an X direction where the deviation detecting patterns Q have been read to acquire the intersection deviation value Y (note: the posterior index letter is "0" when representing an average value).

In S105, the control device 50 (the second representative value determining unit 56) calculates an average value $Y_{B0}$ (a second representative value) of the intersection deviation values over the whole range of the recording sheet P in the scanning direction when the inkjet head 12 is moved at the moving velocity $V_B$, and calculates an average value $Y_{C0}$ (a second representative value) of the intersection deviation values over the whole range of the recording sheet P in the scanning direction when the inkjet head 12 is moved at the moving velocity $V_C$.

More specifically, in S104, the control device 50 acquires the average value $Y_{A0}$ of the intersection deviation values in the case of the moving velocity $V_A$ of the inkjet head 12, as shown in FIG. 8A. Further, from the intersection deviation values stored in the deviation storing unit 54 in S103, the control device 50 acquires an intersection deviation value $Y_{AB}$ in a position $X=X_B$ (where the deviation detecting patterns Q of the patch Tb are formed) in the patch Ta, in the case of the moving velocity $V_A$ of the inkjet head 12. Likewise, the control device 50 acquires an intersection deviation value $Y_{AC}$ in a position $X=X_C$ (where the deviation detecting patterns Q of the patch Tc are formed) in the patch Ta, in the case of the moving velocity $V_A$ of the inkjet head 12. It is desired that the intersection deviation values $Y_{AB}$ and $Y_{AC}$ are acquired from results obtained by reading deviation detecting patterns Q of the patch Ta printed in the positions $X=X_B$ and $X=X_C$, respectively. However, the intersection deviation values $Y_{AB}$ and $Y_{AC}$ may be acquired based on results obtained by reading deviation detecting patterns Q of the patch Ta printed in positions other than the positions $X=X_B$ and $X=X_C$ and a below-mentioned interpolation function Ga(X). Further, from the intersection deviation values stored in the deviation storing unit 54 in S103, the control device 50 acquires an intersection deviation value $Y_{BB}$ in the patch Tb, that is, in the position $X=X_B$, in the case of the moving velocity $V_B$ of the inkjet head 12, and intersection deviation value $Y_{CC}$ in the patch Tc, that is, in the position $X=X_C$, in the case of the moving velocity $V_C$ of the inkjet head 12.

Variations in the deviation values of ink landing positions in the scanning direction and the intersection deviation values Y are proportional to the moving velocity of the inkjet head 12 and the distance between the inkjet head 12 and the recording sheet P, and are inversely proportional to a flying velocity of an ink droplet. In addition, the distance between the inkjet head 12 and the recording sheet P is regarded as being substantially constant in the same position in the scanning direction on the recording sheet P. Accordingly, when ink droplet flying velocities at the moving velocities $V_A$, $V_B$, and $V_C$ of the inkjet head 12 are represented by "$U_A$," "$U_B$," and "$U_C$," respectively, with respect to the intersection deviation values Y, from the aforementioned relationships, relational expressions "$(Y_{AB}-Y_{AO})$ $(Y_{BB}-Y_{B0})=(V_A/V_B)/(U_A/U_B)$" and "$(Y_{AC}-Y_{AO})/(Y_{CC}-Y_{C0})=(V_A/V_C)/(U_A/U_C)$" hold.

Thereby, a deviation (difference) "$Y_{BB}-Y_{B0}$" of the intersection deviation value $Y_{BB}$ in the position $X=X_B$ in the case of the moving velocity $V_B$ of the inkjet head 12 relative to the average value $Y_{B0}$ is expressed, using the intersection deviation value $Y_{AB}$ in the position $X=X_B$ in the case of the moving velocity $V_A$ of the inkjet head 12 and the average value $Y_{A0}$, as "$(Y_{AB}-Y_{A0})\cdot(U_A/U_B)/(V_A/V_B)$." That is, a relational expression "$Y_{BB}-Y_{B0}=(Y_{AB}-Y_{A0})\cdot(U_A/U_B)/(V_A/V_B)$" holds. Likewise, a relational expression "$Y_{CC}-Y_{C0}=(Y_{AC}-Y_{A0})\cdot(U_A/U_C)/(V_A/V_C)$" holds. In these relational expressions, when the ink droplet flying velocities $U_A$, $U_B$, and $U_C$ are regarded as being approximately the same, the average values $Y_{B0}$ and $Y_{C0}$ are approximately represented by the following expressions 1.

[Expressions 1]

$$Y_{B0} = Y_{BB} - \frac{V_B}{V_A(Y_{AB} - Y_{A0})}$$

$$Y_{C0} = Y_{CC} - \frac{V_C}{V_A(Y_{AC} - Y_{A0})}$$

In S106, based on the average values $Y_{A0}$, $Y_{B0}$, and $Y_{C0}$, the control device 50 (the discharge timing determining unit 58) determines ink discharge timings (moments) (delay times for actual ink discharge timings relative to reference discharge timings) to discharge ink droplets from the nozzles 10.

Specifically, the control device 50 determines, as a delay time for performing the printing operation while moving the inkjet head 12 at the moving velocity $V_A$, for instance, a delay time by which an ink landing position based on the assumption that the recording sheet P is as high as an average height thereof is deviated by a distance of $Y_{A0}$ tan θ in the scanning direction from the ink landing position when the patch Ta has been printed, for each ink discharge timing (moment) in one of the cases where the inkjet head 12 is moved toward the one side along the scanning direction and where the inkjet head 12 is moved toward the other side along the scanning direction. Alternatively, the control device 50 may determine, as a delay time for performing the printing operation while moving the inkjet head 12 at the moving velocity $V_A$, a delay time by which an ink landing position based on the assumption that the recording sheet P is as high as the average height thereof is deviated by a distance of $(Y_{A0}$ tan θ) (½) in the scanning direction from the ink landing position when the patch Ta has been printed, for each ink discharge timing (moment) in both of the cases where the inkjet head 12 is moved toward the one side along the scanning direction and where the inkjet head 12 is moved toward the other side along the scanning direction.

Likewise, the control device 50 determines, as a delay time for performing the printing operation while moving the inkjet head 12 at the moving velocity $V_B$, for instance, a delay time by which an ink landing position based on the assumption that the recording sheet P is as high as the average height thereof is deviated by a distance of $Y_{B0}\cdot$tan θ in the scanning direction from the ink landing position when the patch Tb has been printed, for each ink discharge timing (moment) in one of the cases where the inkjet head 12 is moved toward the one side along the scanning direction and where the inkjet head 12 is moved toward the other side along the scanning direction. Alternatively, the control device 50 may determine, as a delay time for performing the printing operation while moving the inkjet head 12 at the moving velocity $V_B$, a delay time by which an ink landing position based on the assumption that the recording sheet P is as high as the average height thereof is deviated by a distance of $(Y_{B0}\cdot$tan θ$)\cdot(½)$ in the scanning direction from the ink landing position when the patch Tb has been printed, for each ink discharge timing (moment) in both of the cases where the inkjet head 12 is moved toward the one side along the scanning direction and where the inkjet head 12 is moved toward the other side along the scanning direction.

Further, likewise, the control device 50 determines, as a delay time for performing the printing operation while moving the inkjet head 12 at the moving velocity $V_C$, for instance, a delay time by which an ink landing position based on the assumption that the recording sheet P is as high as the average height thereof is deviated by a distance of $Y_{C0}\cdot$tan θ in the scanning direction from the ink landing position when the patch Tc has been printed, for each ink discharge timing (moment) in one of the cases where the inkjet head 12 is moved toward the one side along the scanning direction and where the inkjet head 12 is moved toward the other side along the scanning direction. Alternatively, the control device 50 may determine, as a delay time for performing the printing operation while moving the inkjet head 12 at the moving velocity $V_C$, a delay time by which an ink landing position based on the assumption that the recording sheet P is as high as the average height thereof is deviated by a distance of $(Y_{C0}\cdot$tan θ$)\cdot(½)$ in the scanning direction from the ink landing position when the patch Tc has been printed, for each ink discharge timing (moment) in both of the cases where the inkjet head 12 is moved toward the one side along the scanning direction and where the inkjet head 12 is moved toward the other side along the scanning direction.

Then, in the printing operation, the control device 50 controls the inkjet head 12 to discharge ink droplets from the nozzles 10 at ink discharge timings (moments) each delayed by the delay time determined in S106 with respect to the reference discharge timing.

Under an assumption that the gap between the ink discharge surface 12*a* and the recording sheet P does not vary, the deviations (differences) of the deviation value of ink landing positions in each position in the scanning direction on the recording sheet P relative to the average values $Y_{A0}$, $Y_{B0}$, and $Y_{C0}$ are proportional to the moving velocity of the inkjet head 12, and are inversely proportional to the ink droplet flying velocity. Under an assumption that the ink droplet flying velocity is constant regardless of the moving velocity of the inkjet head 12, by acquiring an average value of the deviation values of ink landing positions at one of the moving velocities of the inkjet head 12, it is possible to acquire average values of the deviation values of ink landing positions at the other moving velocities of the inkjet head 12. Nonetheless, actually, the ink droplet flying velocity slightly varies depending on the moving velocity of the inkjet head 12. Accordingly, it is required to acquire the average value of the deviation values of ink landing positions for each moving velocity of the inkjet head 12.

Meanwhile, unlike the embodiment, the average values $Y_{B0}$ and $Y_{C0}$ may be acquired by printing the same patches as the patch Ta over the whole range in the scanning direction while moving the inkjet head 12 at the moving velocities $V_B$ and $V_C$, and reading the printed patches.

However, when a plurality of patches are printed over the whole range of the recording sheet P in the scanning direction, conditions for the gap between the ink discharge surface 12*a* and the recording sheet P vary from one patch to another, owing to swelling of ink. Additionally, when the plurality of patches are printed over the whole range of the recording sheet P in the scanning direction, the plurality of patches are printed to be arranged along the sheet feeding direction. Hence, as the number of the patches increases, a length in the sheet feeding direction of the recording sheet P required for printing the patches becomes longer. Thus, the conditions for the gap between the ink discharge surface 12*a* and the recording sheet P vary from one patch to another.

Further, when the patches are printed on respective recording sheets P differing depending on the moving velocities of the inkjet head 12, the conditions for the gap between the ink discharge surface 12*a* and the recording sheet P vary from one patch to another, due to floating and/or deformation caused in the scanning direction in a manner differing from one recording sheet to another.

As described above, when the conditions for the gap between the ink discharge surface 12*a* and the recording sheet P vary, the determined average values $Y_{A0}$, $Y_{B0}$, and $Y_{C0}$ might not accurate. Moreover, when the plurality of patches are printed over the whole range of the recording sheet P in the scanning direction, it takes a long time to read the patches by the image scanner 66.

On the contrary, in the embodiment, as described above, the average value $Y_{A0}$ is determined by printing the patch Ta over the whole range of the recording sheet P in the scanning direction and reading the patch Ta. Further, the average value $Y_{B0}$ is determined based on the intersection deviation value $Y_{BB}$ acquired by printing the patch Tb in a partial range of the recording sheet P in the scanning direction and reading the patch Tb, the deviation (difference) of the intersection deviation value $Y_{AB}$ acquired by reading the patch Ta relative to the average value $Y_{A0}$, and the ratio ($V_B/V_A$) of the moving velocities of the inkjet head 12. Furthermore, the average value $Y_{C0}$ is determined based on the intersection deviation value $Y_{CC}$ acquired by printing the patch Tc in a partial range of the recording sheet P in the scanning direction and reading the patch Tc, the deviation (difference) of the intersection deviation value $Y_{AC}$ acquired by reading the patch Ta relative to the average value $Y_{A0}$, and the ratio ($V_C/V_A$) of the moving velocities of the inkjet head 12.

Namely, it is possible to acquire the average values $Y_{B0}$ and $Y_{C0}$ of the intersection deviation values at the moving velocities $V_B$ and $V_C$ of the inkjet head 12, without having to print separate patches over the whole range of the recording sheet P in the scanning direction.

At this time, as the first representative value, determined is the average value $Y_{A0}$ of the intersection deviation values for the moving velocity $V_A$ of the inkjet head 12. Therefore, as the second representative values, it is possible to determine the average values $Y_{B0}$ and $Y_{C0}$ of the intersection deviation values at the moving velocities $V_B$ and $V_C$ of the inkjet head 12. When each second representative value is the average value of the intersection deviation values, it results in a small average value of the difference between the intersection deviation value in each portion of the recording sheet P and the second representative value. Thus, it is possible to render smaller an average value of the deviation values of ink landing positions when the ink discharge timings (moment) are corrected based on the delay times determined based on the second representative values.

Further, a portion of the recording sheet P closer to an end of the recording sheet P is more likely to be easily displaced. In other words, the gap between the ink discharge surface 12*a* and the recording sheet P is the most stable in a central portion of the recording sheet P. Thus, in the embodiment, as described above, the patch Ta is printed substantially in the central portion of the recording sheet P in the sheet feeding direction. Thereby, the average value $Y_{A0}$ determined from the results obtained by reading the patch Ta is rendered accurate. Thus, the average values $Y_{B0}$ and $Y_{C0}$ determined based on the average value $Y_{A0}$ is rendered accurate.

Further, the patches Tb and Tc are printed in the different position in the sheet feeding direction from the patch Ta on the same recording sheet P. Therefore, conditions such as floating and/or deformation of the recording sheet P along the scanning direction have as much influence on printed results of the patches Tb and Tc as influence on a printed result of the patch Ta. Accordingly, as described above, the acquired average values $Y_{B0}$ and $Y_{C0}$ are rendered accurate with any influence thereon of the conditions such as floating and/or deformation of the recording sheet P being eliminated.

Further, in general, when a sheet member is deformed and held in a wave shape along a predetermined direction, it is possible to enhance a bending stiffness of the sheet member with respect to a direction perpendicular to the predetermined direction. Thus, it is possible to stabilize the shape of the sheet member with respect to the direction perpendicular to the predetermined direction. Accordingly, in the embodiment, on the recording sheet P, the deviation values of ink landing positions is likely to vary depending on the position in the scanning direction, but is less likely to vary depending on the position in the sheet feeding direction. Therefore, the intersection deviation values acquired based on the patches Ta, Tb, and Tc certainly correspond to the deviation values of ink landing positions in the scanning direction. Thus, it is possible to acquire the accurate average values $Y_{A0}$, $Y_{B0}$, and $Y_{C0}$.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations about the same configurations as exemplified in the aforementioned embodiment will be omitted.

[Modifications]

In the aforementioned embodiment, in S106, the delay time is uniformly determined for each moving velocity of the inkjet head 12. However, in a first modification according to aspects of the present invention, in order to more accurately correct the deviation values of ink landing positions, the delay time may be determined depending on the variation in the gap between the ink discharge surface 12*a* and the recording sheet P along the scanning direction, in addition to the moving velocities of the inkjet head 12.

More specifically, as shown in FIG. 9, the control device 50 may further include an interpolation function determining unit 71 and a deviation calculating unit 72. The interpolation function determining unit 71 may be configured to determine interpolation functions Ga(X), Gb(X), and Gc(X) for the intersection deviation values Y over the whole range in the scanning direction at the moving velocities $V_A$, $V_B$, and $V_C$, respectively. The deviation calculating unit 72 may be configured to calculate an intersection deviation value corresponding to a position of the inkjet head 12, based on the printing mode determined by the mode determining unit 51, the position of the inkjet head 12 detected by the head position detecting unit 57, and one of the interpolation functions Ga(X), Gb(X), and Gc(X). The discharge timing determining unit 58 may be configured to determine an ink discharge timing (moment) based on the intersection deviation value calculated by the deviation calculating unit 72.

In the first modification, in order to determine the ink discharge timings (moments) to discharge ink droplets from the nozzles 10 and perform a printing operation in accordance with the determined ink discharge timings, the steps S101 to S106 as shown in FIG. 6 may previously be performed in advance of execution of the printing operation using the inkjet printer 1 (e.g., at a stage of manufacturing the inkjet printer 1) in the same manner as the aforementioned embodiment. Thereafter, in the printing operation, steps S201 to S204 as shown in FIG. 11 may be performed.

In S201, the control device 50 (the interpolation function determining unit 71) determines an interpolation function for calculating an intersection deviation value in each position in the scanning direction.

More specifically, as described above, when the recording sheet P is held in the wave shape along the scanning direction, the wave shape is graphically shown with the position X in the scanning direction as a horizontal axis and a height Z of the recording sheet P in the vertical direction as a vertical axis, as illustrated in FIG. 10A. Here, "$X_N$" represents a position of an N-th examined section Pe in the scanning direction. "$S_N$" represents a segment from "$X=X_N$" to "$X=X_{N+1}$." In FIG. 10A, values of the height Z over the whole range of the recording sheet P in the scanning direction are expressed as "Z=H(X)." Here, "$Z_0$" represents an average value of the height Z.

FIG. 10B graphically shows deviation values W(W=Fa(X)) of ink landing positions in the scanning direction at the moving velocity $V_A$ of the inkjet head 12 (a vertical axis), as a function of the position X in the scanning direction (a horizontal axis). In the following description, "$W_0$" represents a deviation value of ink landing positions in the scanning direction when $Z=Z_0$. According to a relational expression"(a moving distance of an ink droplet)=(a velocity of the ink droplet)×(a flying time of the ink droplet)," since the ink droplet moves in the vertical direction and the scanning direction within the same flying time, the following relational expression holds: "(a moving distance of the ink droplet in the vertical direction)/(a velocity of the ink droplet in the vertical direction)=(a moving distance of the ink droplet in the scanning direction)/(a velocity of the ink droplet in the scanning direction)." Namely, a relational expression "$(Z-Z_0)/U_A=(W-W_0)/V_A$" holds. Here, "$Z_0$," "$W_0$" "U," and "V" are constant values that do not depend on the value of "X." Therefore, the functions "Z=H(X)" and "W=Fa(X)" provide substantially similar wave shapes.

Further, FIG. 10C graphically shows intersection deviation values Y (Y=Ga(X)) of the pattern intersection in the sheet feeding direction at the moving velocity $V_A$ of the inkjet head 12 (a vertical axis), as a function of the position X in the scanning direction (a horizontal axis). As described above, since Y=W/tan θ, the function "Y=Ga(X)" provides a wave shape similar to the wave shapes of "Z=H(X)" and "W=Fa(X)." $Y_{A0}$ is an average value of the intersection deviation values Y. It is noted that the aforementioned relationships hold with respect to interpolation functions Fb(X) and Fc(X) for the deviation value W at the moving velocities VB and VC of the inkjet head 12, and interpolation functions Gb(X) and Gc(X) for the intersection deviation value Y at the moving velocities VB and VC of the inkjet head 12.

Accordingly, as shown in FIGS. 10B and 10C, the variation of the deviation value W of ink landing positions in the scanning direction and the variation of the intersection deviation value Y depending on the position X in the scanning direction are expressed as graphs transformable to be coincident with a graph for representing the variation of the height Z of the recording sheet P by scaling and translation along the vertical axis. Namely, the graph of the interpolation function Ga(X) for the intersection deviation value Y is transformed, by scaling and translation along the vertical axis, into the graph of the interpolation function H(X) for the height Z of the recording sheet P and into the graph of the interpolation function Fa(X) for the positional deviation value W of ink landing positions.

The same applies to a below-mentioned graph shown in FIG. 10D for representing a variation of a correction value for correcting the ink discharge timing. Thus, the four pieces of information (the four functions) shown in FIGS. 10A to 10D are substantially equivalent when the respective relevant constant values are known. Therefore, even when the deviation storing unit 54 stores any one of the four functions, or even when interpolation calculation is made using any one of the four functions, it is possible to correct the deviation values of ink landing positions through appropriate transformation for the functions. In the first modification, the following description will be provided based on an assumption that the deviation storing unit 54 stores the intersection deviation values Y.

For each individual one of the segments into which the patch Ta is partitioned by the examined sections Pe in the scanning direction, the interpolation function Ga(X) is determined as a polynomial such as a cubic function of the position X in the scanning direction or a sine function of the position X, from the intersection deviation values of the examined sections Pe that define each individual segment (e.g., the intersection deviation value $Y_N$ in the position $X=X_N$ and the intersection deviation value $Y_{N+1}$ in the position $X=X_{N+1}$ in the segment $S_N$). In FIG. 10C, an interpolation function $Ga_N$(X) represents an interpolation function for the intersection deviation values Y in the segment $S_N$. Then, when the moving velocity of the inkjet head 12 is the moving velocity $V_A$, the interpolation function Ga(X) is determined as the interpolation function for the intersection deviation values.

When the moving velocity of the inkjet head 12 is the moving velocity $V_B$, the interpolation functions Gb(X) for calculating the intersection deviation values over the whole range in the scanning direction is determined based on the interpolation function Ga(X). Then the interpolation function Gb(X) is determined as the interpolation function for the intersection deviation values. Likewise, when the moving velocity of the inkjet head 12 is the moving velocity $V_C$, the interpolation functions Gc(X) for calculating the intersection deviation values over the whole range in the scanning direction is determined based on the interpolation function Ga(X). Then the interpolation function Gc(X) is determined as the interpolation function for the intersection deviation values. Specifically, in the same manner as when the average values $Y_{B0}$ and $Y_{C0}$ are determined in the aforementioned embodiment, relational expressions "$Gb(X)-Y_{B0}=(Ga(X)-Y_{A0})\cdot(U_A/U_B)/(V_A/V_B)$" and "$Gc(X)-Y_{C0}=(Ga(X)-Y_{A0})\cdot(U_A/U_C)/(V_A/V_C)$" hold. Accordingly, when the ink droplet flying velocities $U_A$, $U_B$, and $U_C$ are regarded as being approximately the same, the interpolation functions Gb(X) and Gc(X) are represented by the following expressions 2.

[Expressions 2]

$$Gb(X) = Y_{B0} + \frac{V_B}{V_A}\{Ga(X) - Y_{A0}\}$$

$$Gc(X) = Y_{C0} + \frac{V_C}{V_A}\{Ga(X) - Y_{A0}\}$$

In S202, while the carriage 11 is moving, the control device 50 detects a position in the scanning direction of the inkjet head 12 reciprocating together with the carriage 11 along the scanning direction, by the head position detecting unit 57. In S203, the control device 50 (the deviation calculating unit 72) calculates an intersection deviation value on each portion of the recording sheet P. Specifically, while the inkjet head 12 is moving together with the carriage 11, the control device 50 calculates an intersection deviation value based on the interpolation function determined in S201 (one of the interpolation functions Ga(X), Gb(X), and Gc(X) that corresponds to the printing mode (the moving velocity of the inkjet head 12)) and the position of the inkjet head 12 detected in S202 (corresponding to the position X, i.e., the X coordinate).

In S204, the control device 50 (the discharge timing determining unit 58) determines an ink discharge timing (moment) to discharge an ink droplet from the nozzles 10, based on the intersection deviation value calculated in S203. Specifically, a relational expression "$[H(X)-Z_0]:[F(X)-W_0]=U:V$" holds, where F(X) represents one of the functions Fa(X), Fb(X), and Fc(X) that corresponds the moving velocity of the inkjet head 12, G(X) represents one of the functions Ga(X), Gb(X), and Gc(X) that corresponds the moving velocity of the inkjet head 12, "U" represents one of the flying velocities of the ink droplet $U_A$, $U_B$, and $U_C$ that corresponds the moving velocity of the inkjet head 12, and "V" represents a corresponding one of the moving velocities of the inkjet head 12, Further, a relational expression "$[F(X)-W_0]:[G(X)-Y_0]=\sin\theta:\cos\theta$" holds, where "θ" represents an angle between the straight lines L1 and L2 in a deviation detecting pattern Q.

Furthermore, based on a variation in the ink discharging timing (moment) and the deviation value of ink landing positions, a relational expression "$F(X)-W_0=V\cdot(E(X)-D_0)$" holds, where E(X) represents a function of a delay time D for adjusting (delaying) the ink discharging timing (moment) with respect to a design-based ink discharging timing (moment) in the position X. From the aforementioned relationships, the function E(X) is represented by the following expression 3.

(Expression 3)

$$E(X) = \frac{\tan\theta}{V}\{G(X) - Y_0\} + D_0$$

FIG. 10D graphically shows the delay time D=E(X), which is transformed to be coincident with the graphs shown in FIGS. 10A to 10C by scaling and translation along the vertical axis.

The delay time determined in S204 is a value resulting from adding the following two delay times. One is a delay time ($=D_0-Y_0-(\tan\theta/V)$) for correcting a deviation value of ink landing positions in the scanning direction that varies depending on the moving velocity of the inkjet head 12 regardless of whether the recording sheet P is deformed in the wave shape. The other is a delay time ($=(\tan\theta/V)\cdot G(X)$) for correcting a deviation (difference) between a deviation value of ink landing positions in the scanning direction and the average value of deviation values of ink landing positions, the deviation (difference) being caused due to the variation in the scanning direction of the gap between the ink discharge surface 12*a* and the wave-shaped recording sheet P.

In S205, the control device 50 (the recording control unit 52) controls the inkjet head 12 to discharge an ink droplet from the nozzles 10 at the ink discharge timing (moment) determined in S204. Then, the control device 50 repeatedly performs the steps S202 to S205 until determining that the printing operation is completed (S206: No). When determining that the printing operation is completed (S206: Yes), the control device 50 terminates the process shown in FIG. 11. It is noted that, in the first modification, when the inkjet head 12 reaches a predetermined position, the control device 50 receives a signal from the encoder sensor 20 and controls the inkjet head 12 to discharge an ink droplet from the nozzles 10. Therefore, it is difficult for the inkjet head 12 to discharge the ink droplet from the nozzles 10 at a moment earlier than the design-based ink discharging timing (moment). Accordingly, a value satisfying a condition "D≥0" is always selected as"$D_0$."

In the aforementioned embodiment, the patch Ta extending over the whole range of the recording sheet P in the scanning direction is printed substantially in the central portion of the recording sheet P in the sheet feeding direction. However, the patch Ta may be printed in a different position of the recording sheet P in the sheet feeding direction.

In the aforementioned embodiment, the patches Tb and Tc each formed in a partial range of the recording sheet P in the scanning direction are printed in a different position in the sheet feeding direction on the recording sheet P from the position where the patch Ta is printed. However, for instance, the patches Tb and Tc may be printed on a recording sheet P different from the recording sheet P on which the patch Ta is printed. Even in this case, the average values $Y_{A0}$, $Y_{B0}$, $Y_{C0}$ may be determined in the same manner as the aforementioned embodiment, by causing the image scanner 66 to read the patches Ta, Tb, and Tc printed on the different recording sheets P.

In the aforementioned embodiment, in order to adjust the ink discharge timing in response to the three moving velocities $V_A$, $V_B$, and $V_C$ of the inkjet head 12 that differ depending on the printing modes, the one patch Ta extending over the whole range of the recording sheet P in the scanning direction and the two patches Tb and Tc each formed in a partial range of the recording sheet P in the scanning direction are printed.

However, for instance, when the inkjet head 12 is configured to move at only two different velocities, only one patch formed in a partial range of the recording sheet P in the scanning direction may be printed in addition to the patch extending over the whole range of the recording sheet P in the scanning direction. Further, when the inkjet head 12 is configured to move at four or more different velocities, three or more patches each formed in a partial range of the recording sheet P in the scanning direction may be printed in addition to the patch extending over the whole range of the recording sheet P in the scanning direction.

Further, two or more patches extending over the whole range of the recording sheet P in the scanning direction may be printed. For instance, when the inkjet head 12 is configured to move at a lot of different velocities, a plurality of combinations each having a patch extending over the whole range of the recording sheet P in the scanning direction and a patch formed in a partial range of the recording sheet P in the scanning direction may be printed with the inkjet head 12 moved at a plurality of different velocities, respectively. Then, interpolation functions and average values may be determined based on results obtained by reading the plurality of combinations each having the different kinds of patches.

In the aforementioned embodiment, as the first representative value, determined is the average value $Y_{A0}$ of the intersection deviation values in the case of the moving velocity $V_A$ of the inkjet head 12. However, for instance, as the first representative value, a central value of the intersection deviation values in the case of the moving velocity $V_A$ of the inkjet head 12 may be determined. The central value may be an average value of the maximum value and the minimum value of the intersection deviation values.

In this case, as the second representative values, a central value of the intersection deviation values in the case of the moving velocity $V_B$ of the inkjet head 12 and a central value of the intersection deviation values in the case of the moving velocity $V_C$ of the inkjet head 12 may be determined. When the central values are determined as the second representative values, it is possible to render smaller a maximum value of a difference between the intersection deviation value on each portion of the recording sheet P and each second representative value. Therefore, it is possible to render smaller a maximum value of deviation values of ink landing positions in the case where the ink discharge timings (moments) are corrected using delay times determined based on the second representative values.

Further, as the first representative value, any representative value, other than the aforementioned average value and central value, of the intersection deviation values in the case of the moving velocity $V_A$ of the inkjet head 12 may be determined.

In the aforementioned embodiment, all the patches Ta, Tb, and Tc are read out by the image scanner 66. However, for instance, in a second modification according to aspects of the present invention, at the stage of manufacturing the inkjet printer 1, by printing only the patch Ta and reading the printed patch Ta, the average value $Y_{A0}$ may be determined in the same manner as the aforementioned embodiment. Then, the patches Tb and Tc may be printed before actual execution of the printing operation. At this time, as shown in FIG. 12, a plurality of separator lines K that extend in the scanning direction and divide each deviation detecting pattern Q into a plurality of areas R in the sheet feeding direction and numbers I each indicating a corresponding one of the areas R may be printed as well as the deviation detecting patterns Q.

Then, after visually recognizing the patches Tb and Tc, the user may enter a number (in FIG. 12, the number "3") of an area R that includes the intersections of the straight lines L1 and L2 (an area R having the highest brightness) via the operation unit 6. The control device 50 may acquire values that correspond to the values $Y_{BB}$ and $Y_{CC}$ in the aforementioned embodiment, based on the entered number. Thereby, it is possible to determine the average values $Y_{B0}$ and $Y_{C0}$ in the same manner as the aforementioned embodiment.

In the aforementioned embodiment, the patch Ta is printed over the whole range of the recording sheet P in the scanning direction. However, for instance, when the recording sheet P is partially deformed in the wave shape, the patch Ta may be printed on only the part of the recording sheet P deformed in the wave shape.

In the aforementioned embodiment, by the corrugated plates 15, the ribs 16, and the corrugated spur wheels 18 and 19, the recording sheet P is deformed in the wave shape along the scanning direction. However, the inkjet printer 1 may be configured without the corrugated plates 15, the ribs 16, and the corrugated spur wheels 18 and 19. Even though the gap between the ink discharge surface 12*a* and the recording sheet P varies in the scanning direction in a manner different from the aforementioned embodiment or is constant regardless of the position in the scanning direction, in the case where a posture of the recording sheet P when the patch Ta is printed is considered as being approximately the same as a posture of the recording sheet P when the patches Tb and Tc are printed, it is possible to acquire a representative value of the intersection deviation values for each moving velocity of the inkjet head 12 and correct the ink landing positions based on the acquired representative values, in the same manner as described above.

In the aforementioned embodiment, each individual deviation detecting patter Q includes a straight line L1 parallel to the sheet feeding direction and a straight line L2 that is tilted with respect to the sheet feeding direction and intersects the straight line L1. However, each deviation detecting pattern may be any other pattern that provides printed results varying in response to a deviation (difference) in the scanning direction between a landing position of an ink droplet discharged when the inkjet head 12 is moved toward the one side along the scanning direction and a landing position of an ink droplet discharged when the inkjet head 12 is moved toward the other side along the scanning direction.

In the aforementioned embodiment, the ink landing positions are corrected using the first representative value and the second representative values with the ink discharge timings (moments) being shifted by an adjustment time. However, instead, the ink landing positions may be corrected with image data being printed in a manner shifted by an adjustment distance, as a result, with the ink discharge timings (moments) being shifted.

What is claimed is:

1. A method for acquiring a deviation value between an ink landing position of an ink droplet discharged from an inkjet head of an inkjet printer moving toward a first side along a scanning direction and an ink landing position of an ink droplet discharged from the inkjet head moving toward a second side opposite to the first side along the scanning direction, for each of different moving velocities of the inkjet head, the inkjet printer configured to perform printing on a recording sheet by discharging ink droplets from nozzles formed in an ink discharge surface of the inkjet head while reciprocating the inkjet head relative to the recording sheet along the scanning direction parallel to the ink discharge surface, the method comprising:

a first pattern printing step of printing a first pattern over a first range of the recording sheet in the scanning direction, by discharging ink droplets from the nozzles while reciprocating the inkjet head at a first moving velocity along the scanning direction, the first pattern being a pattern for acquiring a first deviation value that is the deviation value of the ink landing positions in the first range when the inkjet head moves at the first moving velocity;

a second pattern printing step of printing a second pattern over a second range of the recording sheet in the scanning direction, the second range being included in and shorter than the first range in the scanning direction, by discharging ink droplets from the nozzles while reciprocating the inkjet head at a second moving velocity different from the first velocity along the scanning direction, the second pattern being a pattern for acquiring a second deviation value that is the deviation value of the ink landing positions in the second rangewhen range when the inkjet head moves at the second moving velocity;

a first deviation acquiring step of acquiring, from the first pattern, the first deviation value in each of a plurality of positions in the first range;

a variation acquiring step of acquiring variation information that represents a variation in the scanning direction of the first deviation value acquired in each of the plurality of positions in the first range;

a first representative value acquiring step of acquiring, from the variation information, a first representative value that represents the first deviation value acquired in each of the plurality of positions in the first range;

a second deviation acquiring step of acquiring the second deviation value from the second pattern; and a second representative value acquiring step of acquiring a second representative value that represents the deviation value of the ink landing positions in the first range when the inkjet head moves at the second moving velocity, based on the second deviation value and a difference between the first representative value and the first deviation value acquired in the second range included in the first range.

2. The method according to claim 1, further comprising a correcting step of rendering the second deviation value smaller by the second representative value than a value acquired as the second deviation value when the second pattern has been printed, by correcting at least one of an ink landing position of an ink droplet discharged from the nozzles when the inkjet head moves at the second moving velocity toward the first side along the scanning direction and an ink landing position of an ink droplet discharged from the nozzles when the inkjet head moves at the second moving velocity toward the second side along the scanning direction.

3. The method according to claim 1, wherein the first representative value is an average value of the first deviation values acquired in the plurality of positions in the first range.

4. The method according to claim 1, wherein the first representative value is an average value of a maximum value and a minimum value of the first deviation values acquired in the plurality of positions in the first range.

5. The method according to claim 1, wherein, in the first pattern printing step, the first pattern is printed in a central portion of the recording sheet in a direction perpendicular to the scanning direction.

6. The method according to claim 1, wherein, in the second pattern printing step, the second pattern is printed in a position different from a position where the first pattern is printed, in a direction perpendicular to the scanning direction on the recording sheet.

7. The method according to claim 1, further comprising a second variation acquiring step of acquiring second variation information that represents a variation in the scanning direction of the deviation value of the ink landing positions in the first range when the inkjet head moves at the second moving velocity, based on the variation information and the second representative value.

8. The method according to claim 1, wherein the inkjet printer comprises a wave shape generating mechanism configured to deform and hold the recording sheet in a predetermined wave shape that has top portions of portions protruding in a first direction toward the ink discharge surface and bottom portions of portions recessed in a second direction opposite to the first direction, the top portions and the bottom portions alternately arranged along the scanning direction.

9. An inkjet printer comprising:

an inkjet head configured to discharge ink droplets from nozzles formed in an ink discharge surface thereof;

a head moving unit configured to reciprocate the inkjet head relative to a recording sheet along a scanning direction parallel to the ink discharge surface; and a control device configured to control the inkjet head and the head moving unit to print a pattern for acquiring a deviation value between an ink landing position of an ink droplet discharged when the inkjet head moves toward a first side along a scanning direction and an ink landing position of an ink droplet discharged when the inkjet head toward a second side opposite to the first side along the scanning direction, for each of different moving velocities of the inkjet head, the control device further configured to control the inkjet head and the head moving unit to:

print a first pattern over a first range of the recording sheet in the scanning direction, by discharging ink droplets from the nozzles while reciprocating the inkjet head at a first moving velocity along the scanning direction, the first pattern being a pattern for acquiring a first deviation value that is the deviation value of the ink landing positions in the first range when the inkjet head moves at the first moving velocity; and print a second pattern in a second range of the recording sheet in the scanning direction, the second range being included in and shorter than the first range in the scanning direction, by discharging ink droplets from the nozzles while reciprocating the inkjet head at a second moving velocity different from the first velocity along the scanning direction, the second pattern being a pattern for acquiring a second deviation value that is the deviation value of the ink landing positions in the second range when the inkjet head moves at the second moving velocity.

10. A deviation value acquiring system comprising:

an image scanner configured to read the first pattern and the second pattern printed by the inkjet printer according to claim 9;

a first deviation acquirer configured to acquire, from a result obtained by reading the first pattern using the image scanner, the first deviation value in each of a plurality of positions in the first range;

a variation acquirer configured to acquire variation information that represents a variation in the scanning direction of the first deviation value acquired in each of the plurality of positions in the first range;

a first representative value acquirer configured to acquire, from the variation information, a first representative value that represents the first deviation value acquired in each of the plurality of positions in the first range;

a second deviation acquirer configure to acquire the second deviation value from a result obtained by reading the second pattern using the image scanner; and a second representative value acquirer configured to acquire a second representative value that represents the deviation value of the ink landing positions in the first range when the inkjet head moves at the second moving velocity, based on the second deviation value and a difference between the first representative value and the first deviation value acquired in the second range included in the first range.

* * * * *